US009707463B2

(12) United States Patent
Hudson

(10) Patent No.: US 9,707,463 B2
(45) Date of Patent: Jul. 18, 2017

(54) HEAVY BAG SUPPORT STAND SYSTEM

(71) Applicant: Shannon Hudson, Simpsonville, SC (US)

(72) Inventor: Shannon Hudson, Simpsonville, SC (US)

( * ) Notice: Subject to any disclaimer, the term of this patent is extended or adjusted under 35 U.S.C. 154(b) by 313 days.

(21) Appl. No.: 14/251,266

(22) Filed: Apr. 11, 2014

(65) Prior Publication Data

US 2015/0290518 A1 Oct. 15, 2015

(51) Int. Cl.

*A63B 69/20* (2006.01)
*A63B 69/22* (2006.01)
*A63B 71/02* (2006.01)

(52) U.S. Cl.

CPC ..... *A63B 69/201* (2013.01); *A63B 71/023* (2013.01); *A63B 69/205* (2013.01); *A63B 69/206* (2013.01); *A63B 2071/024* (2013.01); *A63B 2210/50* (2013.01); *A63B 2225/09* (2013.01); *A63B 2225/093* (2013.01)

(58) Field of Classification Search

CPC ..... A63B 9/00; A63B 17/00; A63B 17/02; A63B 69/00; A63B 69/004; A63B 69/0071; A63B 69/0073; A63B 69/0079; A63B 69/20; A63B 69/201; A63B 69/203; A63B 69/205; A63B 69/206; A63B 69/208; A63B 69/24; A63B 69/34; A63B 69/345

USPC ..... 482/90; 52/146, 152

See application file for complete search history.

(56) References Cited

U.S. PATENT DOCUMENTS 321,564 A * 7/1885 Wright ..... E04H 12/08 52/152
364,674 A * 6/1887 Roberts ..... E04H 12/08 52/152
390,692 A * 10/1888 Miller ..... E06B 11/04 160/379
730,966 A * 6/1903 Reed ..... E04H 12/2276 256/57
866,303 A * 9/1907 Reynolds ..... E04H 12/08 52/152
877,268 A * 1/1908 Van Buren ..... E04H 12/2215 52/165
1,012,419 A * 12/1911 Oppenhauser ..... E04H 12/20 52/146
1,106,468 A * 8/1914 Miohod ..... E04H 12/08 52/152
1,169,822 A * 2/1916 Hindmarsh ..... E04H 12/08 52/152
1,189,596 A * 7/1916 McFadden ..... E04H 12/08 248/163.1
1,334,053 A * 3/1920 Reynolds ..... E04H 12/22 52/152
1,568,777 A * 1/1926 Smith ..... E04H 12/2269 52/146

(Continued)

*Primary Examiner* — Andrew S Lo
(74) *Attorney, Agent, or Firm* — Kirby B. Drake; Klemchuk LLP

(57) ABSTRACT

A compact heavy bag support stand system occupies a relatively small surface area and allows for the quick and convenient installation of a multi-faceted exercise regime system. The system may include a spine having an arm extending outwardly and perpendicularly from a first end, and a dual support limb extending in a downward vertical direction along the spine and a support limb extending outwardly at an angle from a mounting end, the mounting end being fixedly secured to the floor.

18 Claims, 8 Drawing Sheets

(56) References Cited

U.S. PATENT DOCUMENTS 1,689,050 A * 10/1928 Rawley ..... E04H 12/22 52/152
2,351,449 A * 6/1944 Noble ..... E02D 5/80 175/419
2,435,864 A * 2/1948 Adams ..... A63B 69/20 482/90
2,799,369 A * 7/1957 Walton ..... E04H 17/08 52/151
3,239,176 A * 3/1966 Johnson ..... G01C 15/06 248/166
3,510,131 A 5/1970 Gardner
3,538,237 A * 11/1970 Hockaway ..... H02G 7/05 174/43
4,000,592 A * 1/1977 Kelly ..... E04G 21/26 248/354.1
4,158,458 A * 6/1979 Gomez ..... A63B 69/0079 473/575
4,482,150 A 11/1984 Levine
4,557,478 A * 12/1985 Levine ..... A63B 69/201 482/89
5,002,252 A * 3/1991 Setala ..... A47G 33/12 248/523
5,050,866 A 9/1991 Fucci
D335,513 S 5/1993 Gaetano
5,277,679 A * 1/1994 Wells ..... A63B 69/004 482/83
5,286,241 A * 2/1994 Petrakis ..... A63B 69/205 482/83
5,460,343 A 10/1995 Hestilow
5,465,529 A * 11/1995 Park ..... A47G 33/12 248/524
5,725,458 A 3/1998 Newman et al.
5,863,278 A 1/1999 Chen
5,947,847 A * 9/1999 van Nimwegen ... A63B 63/083 473/481
6,220,992 B1 * 4/2001 Shafik ..... A63B 69/20 482/104
6,334,821 B1 * 1/2002 Kita ..... A63B 69/0079 473/422
6,439,344 B1 * 8/2002 Cole ..... E04G 21/3261 182/113
6,655,097 B1 * 12/2003 Poolaw ..... E04H 12/20 248/188.1
6,684,580 B1 * 2/2004 Hull ..... F16M 11/16 256/19
6,736,764 B1 * 5/2004 Kapustka ..... A63B 69/004 482/83
7,458,919 B2 12/2008 Giusti
7,993,107 B2 * 8/2011 Gevers ..... F03D 1/001 248/163.1
D651,675 S 1/2012 Norton
8,991,777 B2 * 3/2015 Madril ..... E04H 12/347 248/206.5
9,056,235 B1 * 6/2015 Mortland ..... A63B 69/24
2002/0169054 A1 * 11/2002 Schwendemann ... A63B 69/004 482/87
2003/0015633 A1 * 1/2003 Pyanowski ..... H01Q 1/12 248/146
2003/0125168 A1 * 7/2003 Hackaday ..... A63B 69/206 482/89
2004/0110607 A1 6/2004 Crespo
2005/0164847 A1 * 7/2005 Giusti ..... A63B 69/20 482/86
2006/0025285 A1 2/2006 Giusti
2006/0025286 A1 2/2006 Shipes
2006/0116225 A1 * 6/2006 Kilpatrick ..... A63B 63/083 473/483
2006/0194675 A1 * 8/2006 Valentine ..... A63B 69/201 482/83
2006/0207215 A1 * 9/2006 Bruno ..... E04G 17/14 52/745.12
2007/0084137 A1 * 4/2007 Pasto ..... E02D 27/42 52/170
2007/0175174 A1 * 8/2007 Bruno ..... E04G 21/26 52/745.12
2008/0076636 A1 * 3/2008 Smith ..... A63B 69/004 482/1
2008/0113852 A1 * 5/2008 Caldwell ..... A63B 21/00047 482/133
2008/0220949 A1 9/2008 Yang
2009/0069161 A1 * 3/2009 Caldwell ..... A63B 21/00047 482/138
2011/0275459 A1 * 11/2011 Polich ..... A63B 69/385 473/462
2012/0252637 A1 * 10/2012 Pellot ..... A63B 69/20 482/89
2012/0309594 A1 12/2012 Hodges
2014/0221171 A1 * 8/2014 Siklosi ..... A63B 69/004 482/87
2014/0302968 A1 * 10/2014 Velikin ..... A63B 1/00 482/40
2014/0309082 A1 * 10/2014 Iglehart ..... A63B 69/32 482/9

* cited by examiner

HEAVY BAG SUPPORT STAND SYSTEM

TECHNICAL FIELD

The present disclosure relates generally to exercise equipment systems, and in particular, to floor-mounted exercise equipment support systems.

BACKGROUND

Boxers, kick boxers, and other martial artists typically train at boxing gyms or other fitness centers having boxing equipment, such as heavy bags. The increasing popularity of boxing, kickboxing and other martial arts as an exercise regimen has spawned classes across the nation in facilities tailored specifically to these classes. These classes or the facilities in general primarily incorporate the use of heavy bag work in which each person may work simultaneously with a bag. Conventional heavy bag mounting supports are typically bulky and/or require extensive installation along the floor, wall and/or ceiling. As such, these mounting supports tend to diminish the surface area available in a space, and thus reduce the number of heavy bags and/or other equipment that may be used in a space.

SUMMARY

Embodiments of the present disclosure generally provide compact, individualized heavy bag support stand systems that provide for reduced surface area allocation and allow for quick and convenient installation.

Embodiments of the present disclosure generally provide an exercise equipment support system mountable to the floor that may include a spine having a first end and a mounting end, the mounting end coupled to the floor via a mounting plate, an arm extending perpendicularly from the first end, and a dual support limb having a U-shaped brace to engage the spine and a pair of legs extending outwardly at an angle from the U-shaped brace with each leg having a mounting plate to separately engage with and couple to the floor. The U-shaped brace may engage the spine along the mounting end of the spine such that the mounting plate of each leg is adjacent to the mounting plate of the spine along the floor. The exercise equipment support system may also include a support limb having a brace and a mounting plate, wherein the brace engages the spine along the spine above the U-brace of the dual support limb, and wherein the mounting plate engages the floor. The mounting plate of the support limb may be fixedly coupled to the floor. The brace may engage the spine along the mounting end of the spine such that the mounting plate of the support limb is adjacent to the mounting plate of the spine along the floor. The exercise equipment support system may further include a support brace oriented between the arm and the spine, such that a first end of the support brace may flatly abut the arm and a second end of the support end may flatly abut the spine. The arm of the exercise equipment support system may include a coupling mechanism to removably couple an article of exercise equipment to the arm. The coupling mechanism may include adapters and a clevis pin to secure a heavy bag, a pair of eyehooks to secure a horizontal bag, a single eyehook to secure a double-end bag, or a fixture to couple to a speed bag platform to secure a speed bag. The spine of the exercise equipment support system may be vertically adjustable. The arm of the exercise equipment support system may be horizontally adjustable.

Embodiments of the present disclosure may further provide a floor-mounted frame that may include a vertical spine having a first section and a second section, the vertical spine mounted to the floor via a mounting plate and extending in an upward direction from the first section to the second section, an arm extending perpendicularly from the second section, the arm having at least one coupling mechanism, and a support limb having a brace to engage the spine along the first section and a mounting plate to engage the floor, wherein the mounting plate of the support limb is adjacent to the mounting plate of the spine along the floor. The floor-mounted frame may also include a dual support limb coupled to the first section between the brace and the floor, the dual support limb having a pair of legs each of which extends outwardly at an angle from the spine, wherein each leg has a mounting plate to engage and couple the floor, and wherein the mounting plate of each leg may be adjacent to the mounting plate of the spine along the floor. The floor-mounted frame may further include a support brace oriented between the arm and the spine, such that a first end of the support brace may flatly abut the arm and a second end of the support brace may flatly abut the spine. The coupling mechanism of the floor-mounted frame may be selected from the group including one or more adapters and pins, one or more eyehooks, and a fixture to support a speed bag platform. The spine of the floor-mounted frame may be vertically adjustable. The arm of the floor-mounted frame may be horizontally adjustable.

Other embodiments of the present disclosure may provide floor-mounted heavy bag support stand system that may include a spine having a first section and a second section, the spine mounted to the floor via a mounting plate and extending in an upward direction from the first section to the second section, an arm extending perpendicularly from the second section, the arm having at least one coupling mechanism to removably couple an article of exercise equipment to the arm, a support brace oriented between the arm and the spine, such that a first end of the support brace may flatly abut the arm and a second end of the support brace may flatly abut the spine, a dual support limb having a U-shaped brace to engage the spine, and a pair of legs that may extend outwardly at an angle from the U-shaped brace with each leg having a mounting plate to engage with and couple to the floor, and a support limb having a brace to engage the spine along the first section and a mounting plate to engage with and couple to the floor. The U-shaped brace of the dual support limb may engage the spine along the first section of the spine such that the mounting plate of each leg may be adjacent to the mounting plate of the spine along the floor. The mounting plate of the support limb may be adjacent to the mounting plate of the spine along the floor. The coupling mechanism may be selected from the group including one or more adapters and pins, one or more eyehooks, and a fixture to support a speed bag platform.

Other technical features may be readily apparent to one skilled in the art from the following figures, descriptions and claims.

BRIEF DESCRIPTION OF THE DRAWINGS

For a more complete understanding of the present disclosure and its features, reference is now made to the following description, taken in conjunction with the accompanying drawings, in which.

DETAILED DESCRIPTION

Systems according to embodiments of the present disclosure generally may provide mounting devices for boxing exercise equipment. This may allow for adaptability to accommodate a plurality of users of varying heights. This also may efficiently provide for a plurality of conditioning needs, while requiring minimal floor space.

Figure 1:
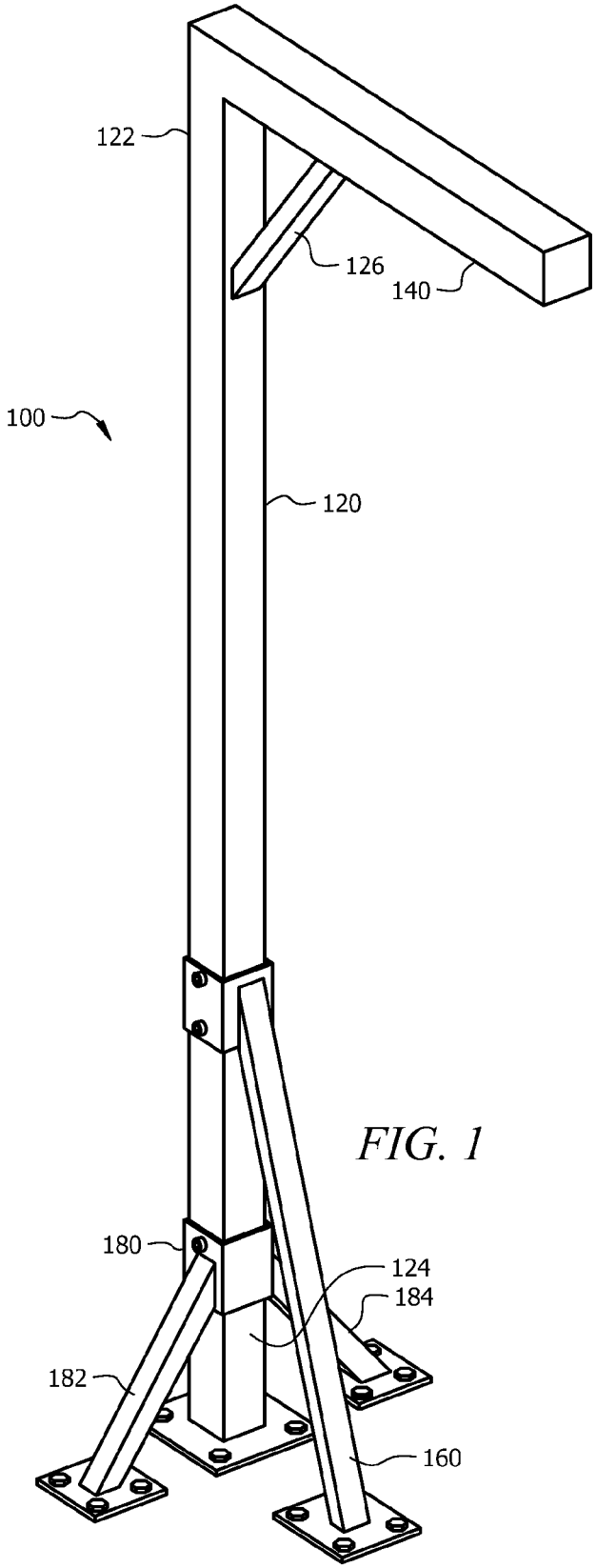
FIG. 1 is a perspective view of a heavy bag support stand system in accordance with one embodiment of the present disclosure.

FIG. 1 generally illustrates heavy bag support stand system 100 according to an embodiment of the present disclosure. It should be understood that system 100 shown in FIG. 1 is for illustrative purposes only and that any other suitable system or subsystem could be used in conjunction with, or in lieu of, system 100 according to one embodiment of the present disclosure.

System 100 may generally comprise a rigid, vertical spine 120 having first end 122 and mounting end 124. In one embodiment, spine 120 may comprise a square tubing having a width measuring in the range of about 4-6 inches, and more preferably about 4 inches, a length measuring in the range of about 4-6 inches, and more preferably about 4 inches, and a height measuring in the range of about 60-120 inches, and more preferably about 96 inches. In various embodiments of the present disclosure, spine 120 may be of any suitable height. In some embodiments, spine 120 may be of a fixed height. In other embodiments, spine 120 may be vertically adjustable to accommodate individual users of varying heights.

In one embodiment, system 100 may be secured to the floor by fixedly coupling mounted end 124 of spine 120 to the floor through mounting plate 128. Mounting plate 128 may have a width measuring in the range of about 8-14 inches, and more preferably about 10 inches, and a length measuring in the range of about 8-14 inches, and more preferably about 10 inches. Mounting end 124 may be connected or otherwise coupled to the floor in any suitable manner that may allow spine 120 to be fixedly secured to the floor, such as, for example, via bolts through ports 130 of mounting plate 128, welding, or any other suitable method including screws, using male and female coupling adapters, a clip or pin attachment, a brass ring and chain attachment, a ball and socket attachment, using other suitable coupling materials, or any combination thereof.

In one embodiment, system 100 may provide a strong foundation and secure support to adequately handle the weight of a variety of different boxing and/or heavy bags, as well as to absorb the force exerted by users working such bags. Accordingly, system 100 may require only minimal floor space, thereby allowing for the optimization of the total floor space in an area for other systems and/or other uses.

In embodiments of the present disclosure, system 100 may further comprise arm 140. Arm 140 may extend generally perpendicularly from first end 122. Arm 140 may be employed to removably secure a variety of boxing and/or heavy bags, such as, a heavy bag, a horizontal bag, a double-end bag, a speed bag, other suitable exercise equipment, or any combination thereof. In an embodiment of the present disclosure, arm 140 may be fixedly coupled to first end 122 of spine 120. In other embodiments, arm 140 may be integrally formed with first end 122 of spine 120. Arm 140 may be further supported and coupled to spine 120 by support brace 126.

In one embodiment, arm 140 may comprise a square tubing having a width measuring in the range of about 4-6 inches, and more preferably about 4 inches, a height measuring in the range of about 4-6 inches, and more preferably about 4 inches, and a length measuring in the range of about 36-60 inches, and more preferably about 48 inches. In some embodiments of the present disclosure, arm 140 may be of a fixed length. In other embodiments of the present disclosure, arm 140 may be horizontally adjustable to accommodate a plurality of different exercise equipment, such as, a heavy bag, a horizontal bag, a double-end bag, a speed bag, other suitable exercise equipment, or any combination thereof. In some embodiments of the present disclosure, the length of arm 140 may be configured so as to optimize the available space in an area, such that arm 140 may extend outward from spine 120 into a space only as far as needed to support one or more of a plurality of different exercise equipment. This may allow for the space in the proximity of system 100 to house another system or for other uses.

Figure 2:
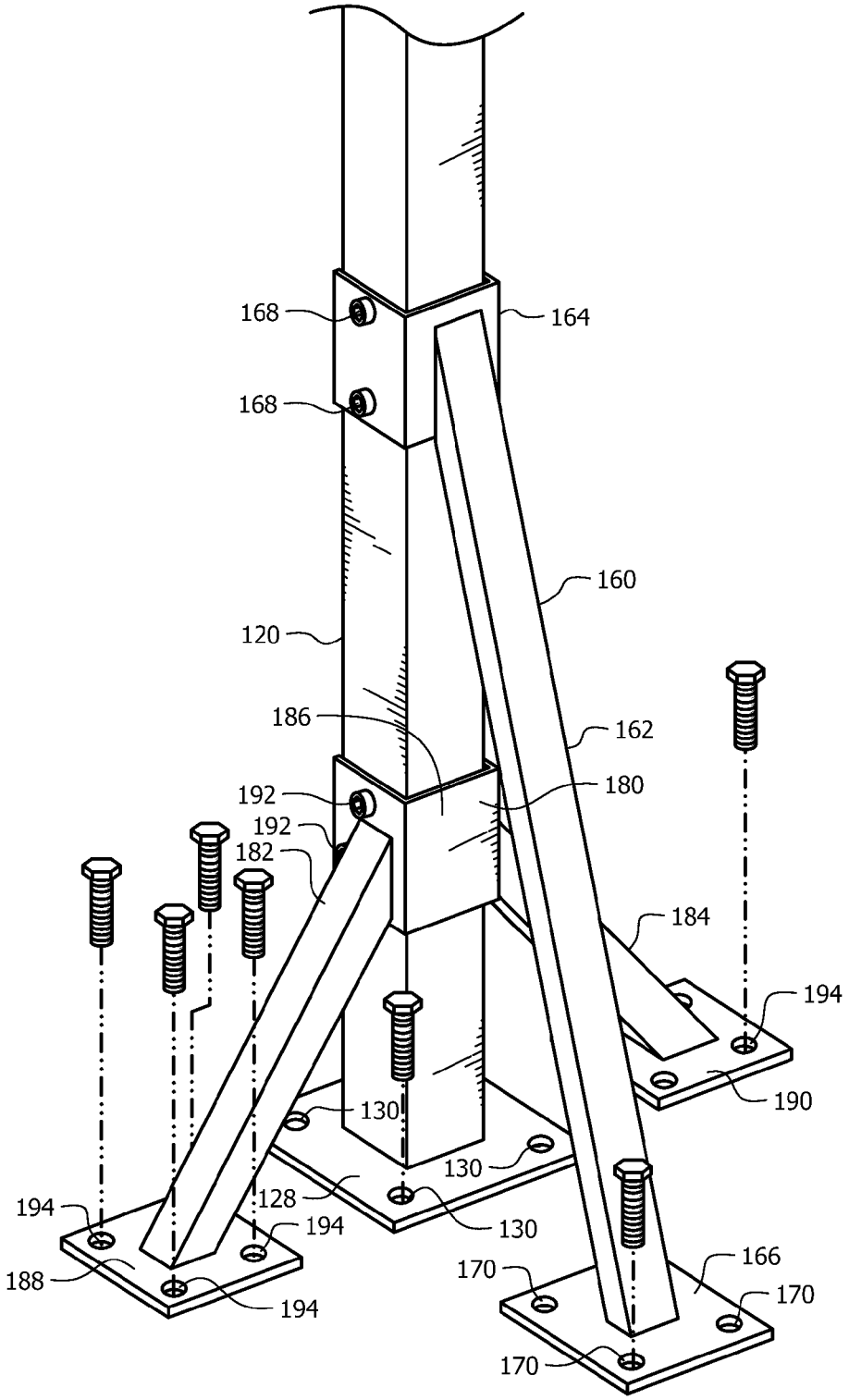
FIG. 2 is a perspective view of a mounting end of a spine of the heavy bag support stand system of FIG. 1 in accordance with one embodiment of the present disclosure.
Figure 5:
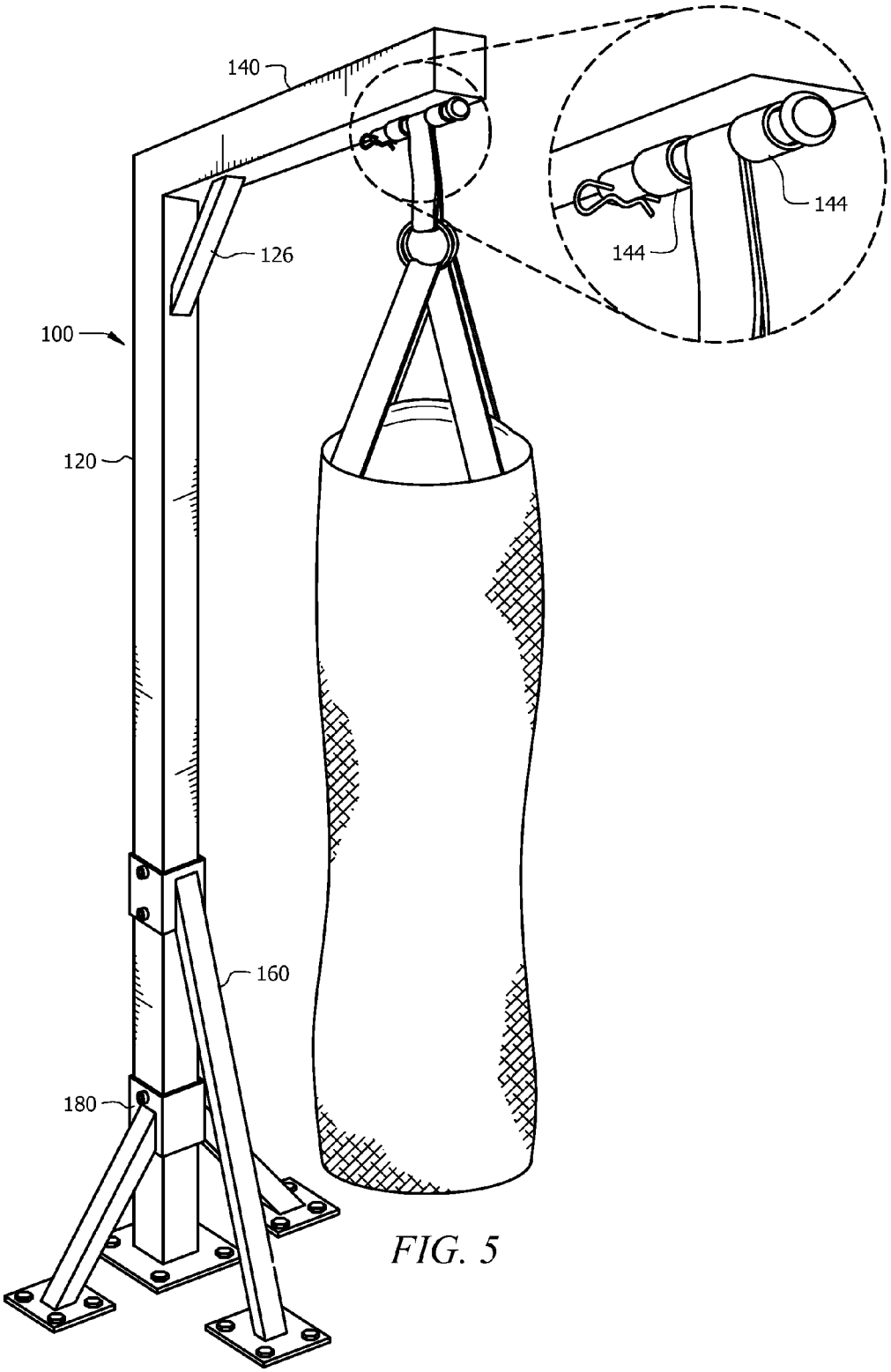
FIG. 5 is a perspective view of the heavy bag support stand system of FIG. 1 employed with a heavy bag in accordance with one embodiment of the present disclosure.
Figure 6:
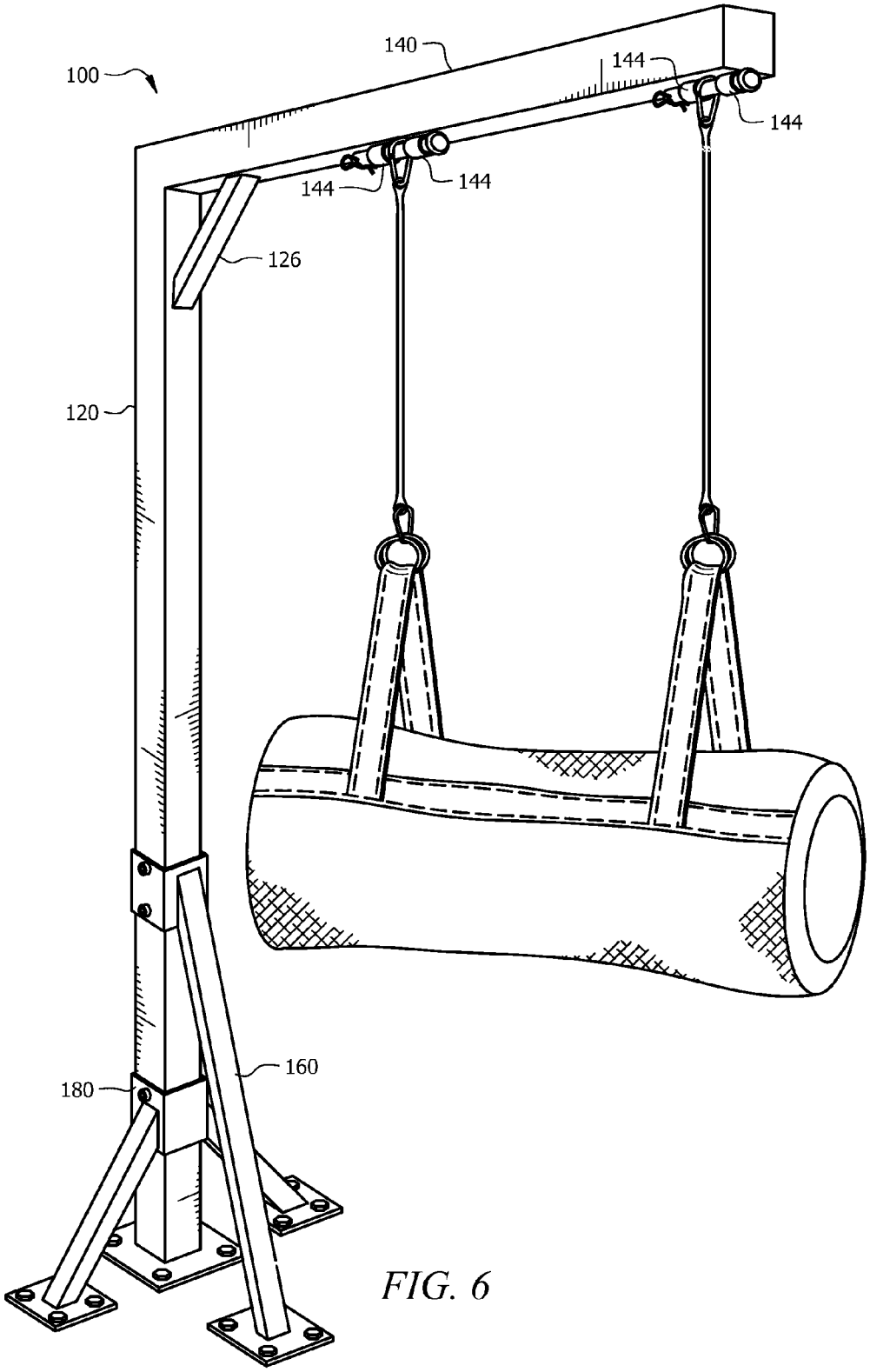
FIG. 6 is a perspective view of the heavy bag support stand system of FIG. 1 employed with a horizontal bag in accordance with one embodiment of the present disclosure.
Figure 7:
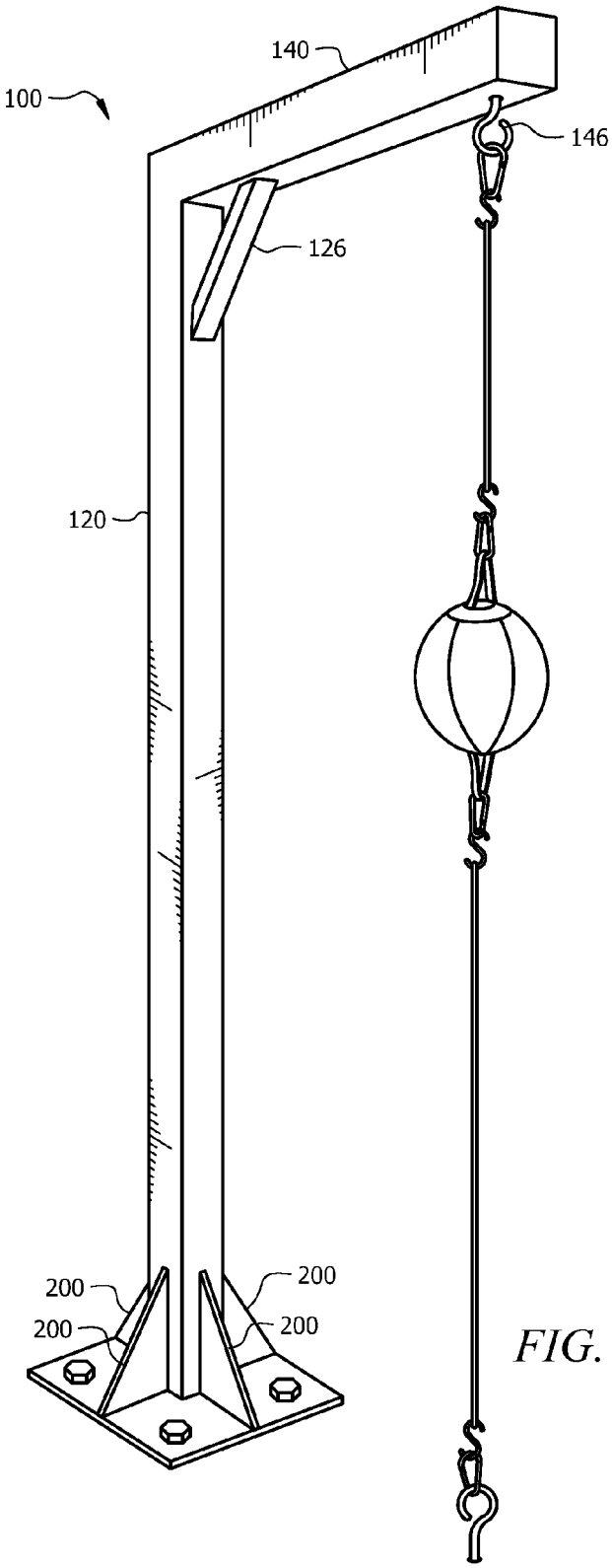
FIG. 7 is a perspective view of the heavy bag support stand system of FIG. 1 employed with a double-end bag in accordance with one embodiment of the present disclosure.
Figure 8:
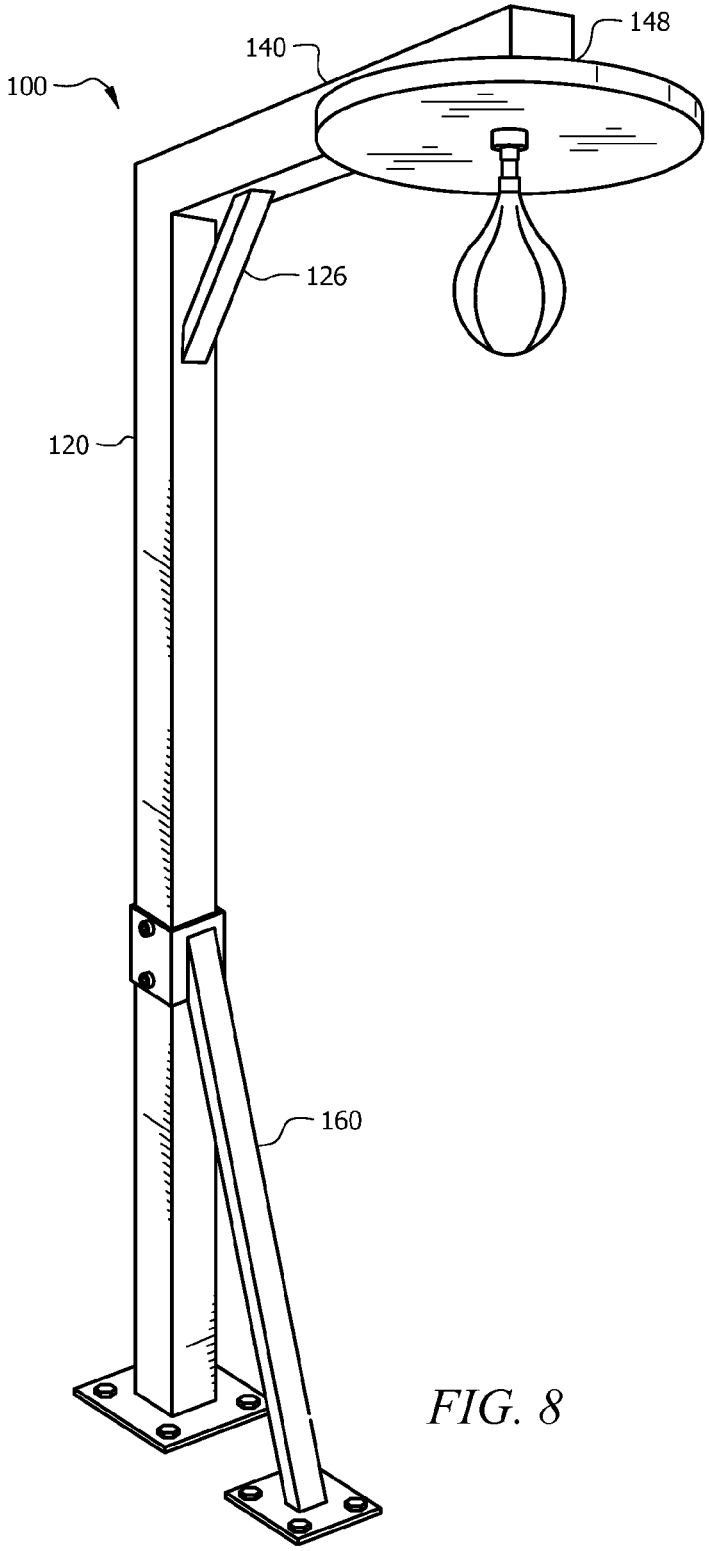
FIG. 8 is a perspective view of the heavy bag support stand system of FIG. 1 employed with a speed bag in accordance with one embodiment of the present disclosure.

In an embodiment of the present disclosure, system 100 may be further supported and secured to the floor through support limb 160 and dual support limb 180, as shown in FIG. 2. In some embodiments of the present disclosure, system 100 may comprise both support limb 160 and dual support limb 180, as shown in FIGS. 5 and 6. In other embodiments of the present disclosure, system 100 may comprise either support limb 160, as shown in FIG. 8, or dual support limb 180, not shown. In alternative embodiments of the present disclosure, system 100 may comprise any other suitable support mechanism, such as, for example, gussets 200 as shown in FIG. 7.

Figure 3:
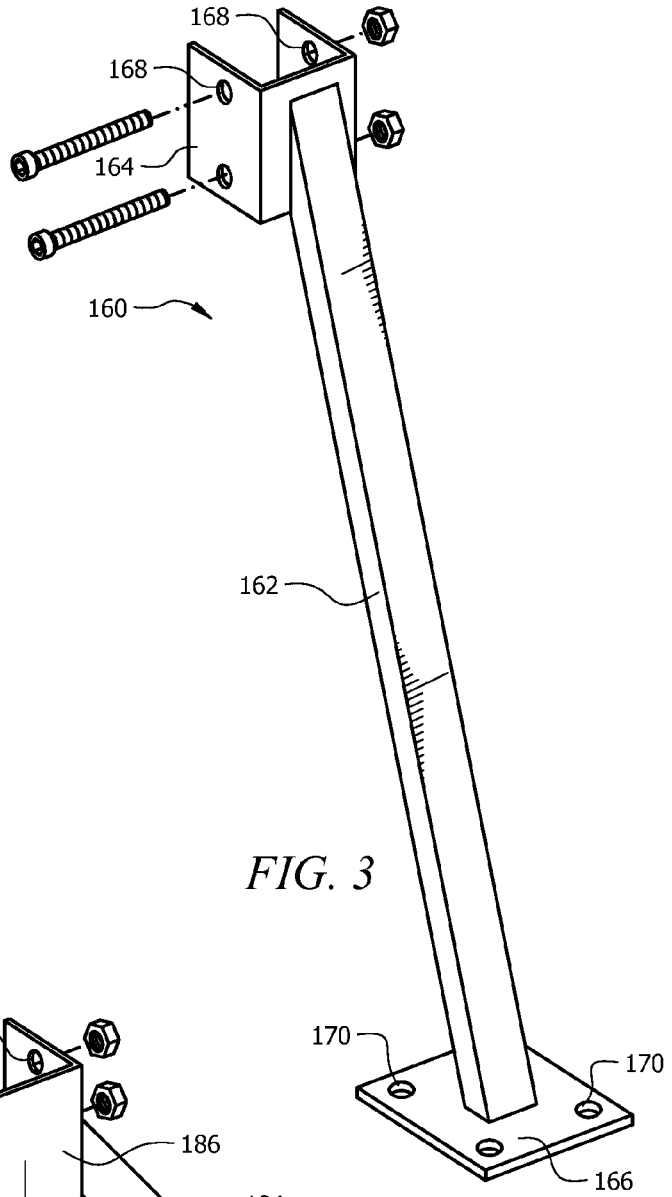
FIG. 3 is a side view of a support limb of the heavy bag support stand system of FIG. 1 in accordance with one embodiment of the present disclosure.

In an embodiment of the present disclosure, support limb 160 may generally include frame 162, U-shaped brace 164 and mounting plate 166. Support limb 160 may be connected or otherwise coupled to spine 120 via U-shaped brace 164, as shown in FIG. 3. In the engaged position, support limb 160 may extend downward from spine 120 towards the floor at an angle, such that each inside surface of U-shaped brace 164 may flatly abut the outside surface of spine 120 and mounting plate 166 may flatly abut the floor. Mounting plate 166 may have a width measuring in the range of about 4-8 inches, and more preferably about 6 inches, and a length measuring in the range of about 4-8 inches, and more preferably about 6 inches.

In an embodiment of the present disclosure, support limb 160 may engage spine 120 such that support limb 160 may be oriented below arm 140 on the same side of spine 120 from which arm 120 extends. In an embodiment of the present disclosure, the angle at which the support limb 160 extends downward towards the floor may be such that mounting plate 166 may be within close proximity to mounting plate 128. This may provide for added structural support to system 100 without diminishing available floor space surface area beyond an inconsequential amount. For example, in some embodiments of the present disclosure, this may be the combined surface area occupied by mounting plate 128 and mounting plate 166.

U-shaped brace 164 of support limb 160 may be connected or otherwise coupled to spine 120 in any suitable manner that may allow support limb 160 to be fixedly secured to spine 120, such as, for example, via bolts through ports 168 as shown in FIG. 2, welding, or any other suitable method including screws, using male and female coupling adapters, a clip or pin attachment, a brass ring and chain attachment, a ball and socket attachment, using other suitable coupling materials, or any combination thereof.

Mounting plate 166 of support limb 160 may be connected or otherwise coupled to the floor in any suitable manner that allows support limb 160 to be fixedly secured to the floor, such as, for example, via bolts through ports 170, welding, or any other suitable method including screws, using male and female coupling adapters, a clip or pin attachment, a brass ring and chain attachment, a ball and socket attachment, using other suitable coupling materials, or any combination thereof.

Figure 4:
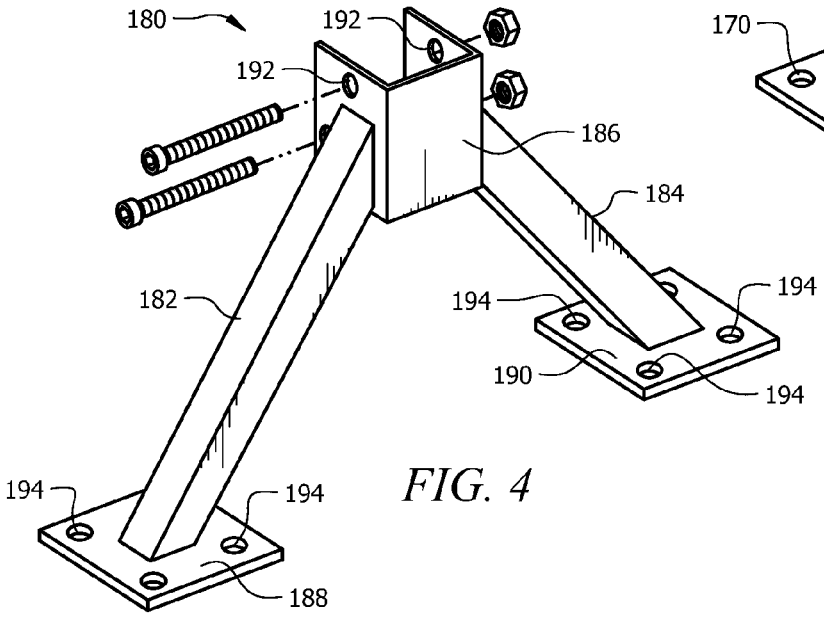
FIG. 4 is a front view of a dual support limb of the heavy bag support stand system of FIG. 1 in accordance with one embodiment of the present disclosure.

In an embodiment of the present disclosure, dual support limb 180 may generally comprise leg 182, leg 184, U-shaped brace 186, mounting plate 188 and mounting plate 190. Leg 182 and leg 184 may extend generally at an angle from opposite ends of U-shaped brace 186, and generally in opposite directions to form a V-shaped configuration, as shown in FIG. 4. However, leg 182 and leg 184 may be oriented in alternative configurations, including U-shaped, O-shaped, D-shaped, or any other suitable shape that may be used to help support spine 120. Leg 182 may be coupled to mounting plate 188, while leg 184 may be coupled to mounting plate 190.

Dual support limb 180 may be connected or otherwise coupled to spine 120 via U-shaped brace 186, as shown in FIG. 4. In the engaged position, dual support limb 180 may extend downward from spine 120 towards the floor, such that each inside surface of U-shaped brace 186 may flatly abut the outside surface of spine 120. In this configuration, mounting plate 188 and mounting plate 190 may flatly abut the floor. Mounting plate 188 may have a width measuring in the range of about 4-8 inches, and more preferably about 6 inches, and a length measuring in the range of about 4-8 inches, and more preferably about 6 inches. Mounting plate 190 may have a width measuring in the range of about 4-8 inches, and more preferably about 6 inches, and a length measuring in the range of about 4-8 inches, and more preferably about 6 inches.

In an embodiment of the present disclosure, dual support limb 180 may engage spine 120 such that leg 182 and leg 184 may be oriented below arm 140, each at approximately a 90 degree angle from the side of spine 120 from which arm 120 extends. In an embodiment of the present disclosure, the angle at which each of leg 182 and leg 184 extends downward towards the floor may be such that mounting plate 188 and mounting plate 190 may be within close proximity to mounting plate 128. This may provide for added structural support to system 100 without diminishing available floor space surface area beyond an inconsequential amount. For example, in some embodiments of the present disclosure, this may be the combined surface area occupied by mounting plate 128, mounting plate 188 and mounting plate 190.

U-shaped brace 186 of dual support limb 180 may be connected or otherwise coupled to spine 120 in any suitable manner that may allow dual support limb 180 to be fixedly secured to spine 120, such as, for example, via bolts through ports 192 as shown in FIG. 2, welding, or any other suitable method including screws, using male and female coupling adapters, a clip or pin attachment, a brass ring and chain attachment, a ball and socket attachment, using other suitable coupling materials, or any combination thereof.

In embodiments comprising both support limb 160 and dual support limb 180, U-shaped brace 186 of dual support limb 180 may be coupled to spine 120 generally below U-shaped brace 164 of support limb 160. Accordingly, system 100 may have additional stability and support, but require only minimal space and materials. In alternative embodiments comprising both support limb 160 and dual support limb 180, U-shaped brace 164 of support limb 160 may be coupled to spine 120 generally below U-shaped brace 186 of dual support limb 180.

Mounting plate 188 and mounting plate 190 of dual support limb 180 may be connected or otherwise coupled to the floor in any suitable manner that may allow dual support limb 180 to be fixedly secured to the floor, such as, for example, via bolts through ports 194, welding, or any other suitable method including screws, using male and female coupling adapters, a clip or pin attachment, a brass ring and chain attachment, a ball and socket attachment, using other suitable coupling materials, or any combination thereof.

Any of mounting plate 128, mounting plate 166, mounting plate 188 and mounting plate 190 may be securely mounted to any suitable floor surface, such as, cement, stone, concrete, brick, tile, wood, other hard surface material, carpet, other soft surface material, other suitable surface, or any combination thereof.

In some embodiments of the present disclosure, supporting limb 160 and dual support limb 180 may be integrally formed with spine 120. In various embodiments of the present disclosure, any of supporting limb 160 and dual support limb 180 may be of any suitable length as needed to accommodate and support the height of spine 120. In some embodiments of the present disclosure, any of supporting limb 160 and dual support limb 180 may be of a fixed length. In other embodiments, the length of any of frame 162 of supporting limb 160, and leg 182 and leg 184 of dual support limb 180 may be adjustable. In some embodiments, any of frame 162 of supporting limb 160, and legs 182, 184 of dual support limb 180 may include a telescoping feature allowing for adjustability by a user to a desired length. In other embodiments, any other suitable method may be employed to cause the length of frame 162 of supporting limb 160, and legs 182, 184 of dual support limb 180 to be adjustable.

In operation, a user may use system 100 in conjunction with a variety of exercises, such as building power, increasing hand eye coordination and timing, and to develop shoulder conditioning and speed. System 100 may be used to support various exercise equipment needed for such exercises, such as, for example, a heavy bag (as shown in FIG. 5), a horizontal bag (as shown in FIG. 6), a double-end bag (as shown in FIG. 7), a speed bag (as shown in FIG. 8), any other suitable exercise equipment, or any combination thereof.

Figure 9:
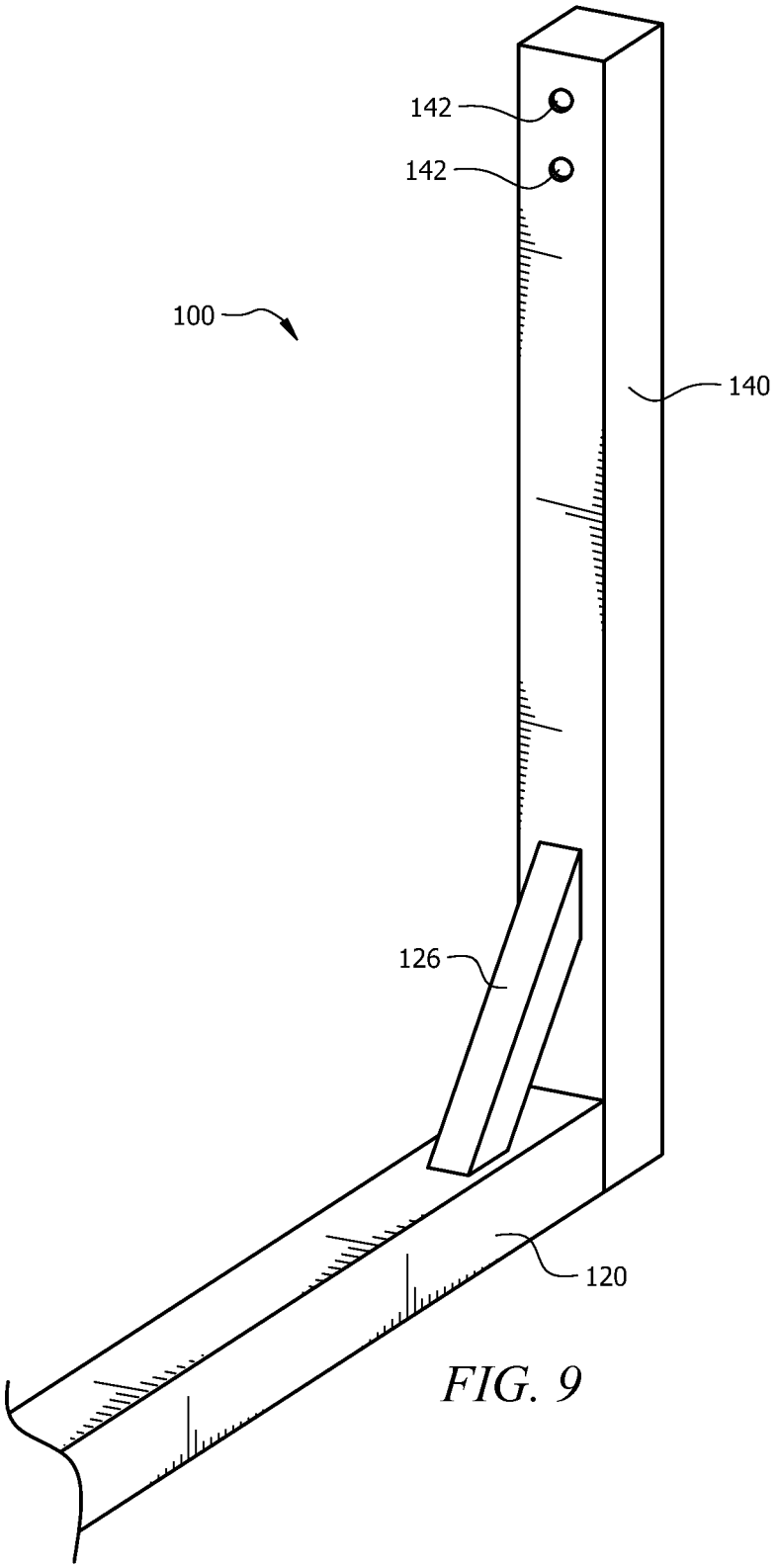
FIG. 9 is a bottom view of an arm of the heavy bag support stand system of FIG. 1 in accordance with one embodiment of the present disclosure.

Such exercise equipment may be suspended and secured to arm 140 of system 100. In an embodiment of the present disclosure, arm 140 may include a plurality of connecting mechanisms 142 to securely couple a variety of exercise equipment, as shown in FIG. 9.

For example, in an embodiment of the present disclosure, arm 140 may include a pair of adapters 144 to accept a clevis pin, as shown in FIG. 5. In operation, a user may loop a strap through the hanging mechanism of a heavy bag and then use the clevis pin to couple the strap to arm 140 between the pair of adapters.

In another embodiment of the present disclosure, arm 140 may include two pairs of adapters 144 to accept two clevis pins, as shown in FIG. 6. In operation, a user may use carabiners and chains to couple a horizontal bag to arm 140.

In another embodiment of the present disclosure, arm 140 may include a single eyehook 146, as shown in FIG. 7. In operation, a user may use a carabiner and chain to couple a double-end bag to arm 140.

In an embodiment of the present disclosure, arm 140 may include coupling mechanism 148, as shown in FIG. 8. In operation, a user may use mount a speed bag platform to coupling mechanism 148 in order to couple a speed bag to arm 140.

In embodiments of the present disclosure, the overall shape and configuration of system 100 may allow for the quick and convenient installation of system 100 so that anyone may easily install such systems with minimal tooling and effort. Once system 100 is oriented in a desired position, a user may securely install system 100 by fixedly coupling mounting plate 128, and mounting plate 166 and/or mounting plate 188 and mounting plate 190 to the floor, as described herein.

In embodiments of the present disclosure, the compact size of system 100 may reduce the surface area necessary for occupation by the support structure, thereby increasing the surface area available in a space for other uses. As described above, spine 120 of system 100 engages the floor via mounting plate 128 of mounting end 124. In some embodiments, system 100 further engages the floor via mounting plate 166 of support limb 160 and mounting plate 188 and mounting plate of dual support limb 180. Furthermore, support limb 160 and dual support limb 180 may retain close proximity to spine 120, thereby decreasing the surface area necessary to be occupied by system 100. This may further optimize available space in an area by allowing for installation of an increased number of systems within the space or utilization of available space for other equipment or activities.

It should be appreciated that system 100 according to embodiments of the present disclosure may be employed and secured in any suitable location. In an embodiment of the present disclosure, system 100 may be removed and reinstalled in any other location, as necessary or as desired by a user. For example, system 100 may be taken from one location and placed in a different location within the same facility to accommodate other exercise equipment. In other embodiments of the present disclosure, system 100 may be taken out of one physical location (in a facility) and moved to a different physical location in a different facility.

In embodiments of the present disclosure, the flexibility of system 100 for use with a variety of different exercises and for use in conjunction with a variety of different exercise equipment may allow for greater efficiency of a space, by allowing for a specified area to be used for a plurality of exercises, rather than necessitating the use of a plurality of different spaces, each dedicated to a specific different exercise or conditioning need. For example, a single system 100 may be installed in a space, but may be utilized for building power, increasing hand eye coordination and timing, developing shoulder conditioning and speed, other conditioning need, or any combination thereof. This may be accomplished by providing for connectivity of one or more pieces of exercise equipment, such as, heavy bags, horizontal bags, double-end bags, speed bags, other suitable equipment, or any combination thereof.

In embodiments of the present disclosure, the individuality of each system may allow for each system to be adapted for the height and desired use of an individual user, thereby allowing for greater adaptability. For example, some systems may be configured to accommodate taller users, while other systems may be configured to accommodate shorter users. In some embodiments, the height of system 100 may be further adaptable by adjusting the height of spine 120 as needed.

It should be appreciated that system 100, according to one embodiment of the present disclosure, also may provide a multi-functional advertising medium. As a plurality users may be in close proximity to system 100 for any extended period of time while working a heavy bag or other such exercise equipment, system 100 may provide a consistent audience to view advertising or other suitable indicia placed on system 100. In an embodiment of the present disclosure, advertising or other suitable indicia may be integrally formed or coupled to any surface of system 100. In some embodiments, the surfaces of system 100 may allow for advertising or other suitable indicia to be removable replaceable with advertising other suitable indicia as needed or desired. This may allow for system 100 to continue to provide relevant multi-functional advertising medium over any duration of time.

In embodiments of the present disclosure, any of spine 120, first end 122, mounting end 124, support brace 126, mounting plate 128, arm 140, connecting mechanisms 142, pair of adapters 144, eyehooks 146, coupling mechanisms 148, support limb 160, frame 162, U-shaped brace 164, mounting plate 166, dual support limb 180, leg 182, leg 184, U-shaped brace 186, mounting plate 188 and/or mounting plate 190 may be formed of steel, stainless steel, aluminum, brass, bronze, light edge steel tubing, metal, wood, nylon, plastic, polyurethane, polyethylene, polyvinyl chloride (PVC), polytetrafluoroethylene (PTFE), polyester, high-gloss polyester, laminate, synthetic rubber, natural rubber, plexiglass, polymer, other suitable materials, or any combination thereof.

In an embodiment of the present disclosure, spine 120, first end 122, mounting end 124, support brace 126, mounting plate 128, ports 130, arm 140, connecting mechanisms 142, pair of adapters 144, eyehooks 146, coupling mechanisms 148, support limb 160, frame 162, U-shaped brace 164, mounting plate 166, ports 168, ports 170, Dual support limb 180, leg 182, leg 184, U-shaped brace 186, mounting plate 188 and/or mounting plate 190, ports 192 and/or ports 194 may also include any number of suitable coatings and layers applied to the base material to substantially reduce injury to a user and/or scratching or injury to surrounding surfaces.

In embodiments of the present disclosure, the coatings and layers that may be applied to spine 120, first end 122, mounting end 124, support brace 126, mounting plate 128, ports 130, arm 140, connecting mechanisms 142, pair of adapters 144, eyehooks 146, coupling mechanisms 148, support limb 160, frame 162, U-shaped brace 164, mounting plate 166, ports 168, ports 170, dual support limb 180, leg 182, leg 184, U-shaped brace 186, mounting plate 188 and/or mounting plate 190, ports 192 and/or ports 194 may be formed of natural rubber, synthetic rubber, polymer, natural fiber, synthetic fiber, polyester, nylon, cotton, cotton mesh, vinyl, other suitable material, or any combination thereof.

In some embodiments of the present disclosure, spine 120, first end 122, mounting end 124, support brace 126, mounting plate 128, arm 140, connecting mechanisms 142, pair of adapters 144, eyehooks 146, coupling mechanisms 148, support limb 160, frame 162, U-shaped brace 164, mounting plate 166, Dual support limb 180, leg 182, leg 184, U-shaped brace 186, mounting plate 188 and/or mounting plate 190 may be embellished with colors, patterns, camouflage patterns, novelty items, ornamental items, stickers, removable stickers, paints, stencils, embossed, engraved, text, logos, designs, images, other decorative materials, or any combination thereof to enhance or otherwise achieve a desired design for system 100.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "adjacent" may refer to two or more elements in close proximity to one another, whether or not those elements are in physical contact with one another.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An exercise equipment support system mountable to a floor, the system comprising:

a spine having a first end and a mounting end, the mounting end coupled to the floor via a mounting plate;

an arm extending perpendicularly from the first end;

a support structure comprising:

a dual support limb, wherein the dual support limb has a U-shaped brace to engage the spine and a pair of legs near a central portion of opposite sides of the U-shaped brace, the legs extending outwardly at an angle from the U-shaped brace with each leg having a mounting plate to separately engage with and couple to the floor, and wherein the U-shaped brace engages the spine along the mounting end of the spine such that the mounting plate of each leg is adjacent to the mounting plate of the spine along the floor; and a support limb having a brace and a mounting plate, wherein the brace engages the spine above the U-shaped brace of the dual support limb, and wherein the mounting plate of the support limb engages the floor.

2. The system of claim 1, wherein the mounting plate of the support limb is fixedly coupled to the floor.

3. The system of claim 1, wherein the brace engages the spine along the mounting end of the spine such that the mounting plate of the support limb is adjacent to the mounting plate of the spine along the floor.

4. The system of claim 1, further comprising:

a support brace oriented between the arm and the spine, such that a first end of the support brace flatly abuts the arm and a second end of the support brace flatly abuts the spine.

5. The system of claim 1, the arm further comprising:

a coupling mechanism to removably couple an article of exercise equipment to the arm.

6. The system of claim 5, the coupling mechanism comprising at least one pair of adapters and a clevis pin.

7. The system of claim 5, the coupling mechanism comprising a pair of eyehooks.

8. The system of claim 5, the coupling mechanism comprising a single eyehook.

9. The system of claim 5, the coupling mechanism comprising a fixture to couple to a speed bag platform.

10. The system of claim 1, wherein the spine is vertically adjustable.

11. The system of claim 1, wherein the arm is horizontally adjustable.

12. A floor-mounted frame configured to support an exercise equipment comprising:

a vertical spine of the floor-mounted frame having a first section and a second section, the vertical spine mounted to the floor via a mounting plate of the spine and extending in an upward direction from the first section to the second section;

an arm extending perpendicularly from the second section, the arm having at least one coupling mechanism;

a support limb having a brace to engage the vertical spine along the first section and a mounting plate of the support limb to engage the floor, wherein the mounting plate of the support limb is adjacent to the mounting plate of the spine along the floor; and a dual support limb having a U-shaped brace to engage the vertical spine wherein the dual support limb is coupled to the first section between the brace and the floor, the dual support limb having a pair of legs each of which extends outwardly at an angle from the spine, wherein each leg has a mounting plate to engage and couple the floor, and wherein the mounting plate of each leg is adjacent to the mounting plate of the spine along the floor, wherein the brace of the support limb engages the vertical spine above the U-shaped brace of the dual support limb.

13. The system of claim 12, further comprising:

a support brace oriented between the arm and the spine, such that a first end of the support brace flatly abuts the arm and a second end of the support brace flatly abuts the spine.

14. The system of claim 12, wherein the coupling mechanism is selected from the group consisting of:

one or more adapters and pins, one or more eyehooks, and a fixture to support a speed bag platform.

15. The system of claim 12, wherein the spine is vertically adjustable.

16. The system of claim 12, wherein the arm is horizontally adjustable.

17. A floor-mounted heavy bag support stand system comprising:

a spine having a first section and a second section, the spine mounted to the floor via a mounting plate of the spine and extending in an upward direction from the first section to the second section;

an arm extending perpendicularly from the second section, the arm having at least one coupling mechanism to removably couple an article of exercise equipment to the arm;

a support brace oriented between the arm and the spine, such that a first end of the support brace flatly abuts the arm and a second end of the support brace flatly abuts the spine;

a dual support limb having a U-shaped brace to engage the spine, and a pair of legs that extend outwardly at an angle from the U-shaped brace with each leg having a mounting plate to engage with and couple to the floor and each leg arranged to engage a central portion of opposite sides of the U-shaped brace; and a support limb having a brace to engage the spine along the first section and a mounting plate adjacent to the mounting plate of the spine along the floor, wherein the mounting plate engages with and couples to the floor, wherein the U-shaped brace of the dual support limb engages the spine along the first section of the spine such that the mounting plate of each leg is adjacent to the mounting plate of the spine along the floor, and wherein the brace of the support limb engages the spine above the U-shaped brace of the dual support limb.

18. The system of claim 17, wherein the coupling mechanism is selected from the group consisting of:

one or more adapters and pins, one or more eyehooks, and a fixture to support a speed bag platform.

* * * * *